US008257890B2

(12) United States Patent
Wu

(10) Patent No.: US 8,257,890 B2
(45) Date of Patent: Sep. 4, 2012

(54) ANTICURL BACKSIDE COATING (ACBC) PHOTOCONDUCTOR

(75) Inventor: Jin Wu, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 419 days.

(21) Appl. No.: 12/550,576

(22) Filed: Aug. 31, 2009

(65) Prior Publication Data

US 2011/0053067 A1 Mar. 3, 2011

(51) Int. Cl.
*G03G 5/04* (2006.01)
*G03G 15/00* (2006.01)

(52) U.S. Cl. ..... 430/58.8; 430/56; 430/69; 430/930

(58) Field of Classification Search ..... 430/58.8, 430/56, 69, 930
See application file for complete search history.

(56) References Cited

U.S. PATENT DOCUMENTS

| | | | | |
|---|---|---|---|---|
| 4,654,284 | A | 3/1987 | Yu et al. | |
| 5,021,309 | A | 6/1991 | Yu | |
| 5,069,993 | A | 12/1991 | Robinette et al. | |
| 5,096,795 | A | 3/1992 | Yu | |
| 5,919,590 | A | 7/1999 | Yu et al. | |
| 5,935,748 | A | 8/1999 | Yu et al. | |
| 6,303,254 | B1 | 10/2001 | Yu et al. | |
| 6,528,226 | B1 | 3/2003 | Yu et al. | |
| 6,939,652 | B2 | 9/2005 | Yu | |
| 8,062,817 | B2 * | 11/2011 | Wu | 430/58.8 |
| 8,067,139 | B2 * | 11/2011 | Wu | 430/58.8 |
| 8,084,112 | B2 | 12/2011 | Wu et al. | |
| 2007/0248813 | A1 * | 10/2007 | Wu et al. | 428/337 |
| 2008/0032216 | A1 * | 2/2008 | Levy et al. | 430/58.8 |
| 2009/0053636 | A1 * | 2/2009 | Lin et al. | 430/58.5 |

OTHER PUBLICATIONS

Jin Wu et al., U.S. Appl. No. 12/360,335 on Nano Diamond Anticurl Backside Coating (ACBC) Photoconductors, filed Jan. 27, 2008.
Jin Wu et al., U.S. Appl. No. 12/033,247 on Anticurl Backside Coating (ACBC) Photoconductors, filed Feb. 19, 2008.
Jin Wu et al., U.S. Appl. No. 12/033,279 on Backing Layer Containing Photoconductor, filed Feb. 19, 2008.

* cited by examiner

*Primary Examiner* — Mark F Huff
*Assistant Examiner* — Jonathan Jelsma
(74) *Attorney, Agent, or Firm* — Eugene O. Palazzo

(57) ABSTRACT

A photoconductor that includes a first layer, a supporting substrate thereover, a photogenerating layer, and at least one charge transport layer of at least one charge transport component, and wherein the first layer is in contact with the supporting substrate on the reverse side thereof, and which first layer is comprised of a crosslinked mixture of a glycoluril resin and a self crosslinking acrylic resin.

36 Claims, No Drawings

ANTICURL BACKSIDE COATING (ACBC) PHOTOCONDUCTOR

CROSS REFERENCE TO RELATED APPLICATIONS

Copending U.S. application Ser. No. 12/550,486, now U.S. Pat. No. 8,084,112, filed Aug. 31, 2009, on Glycoluril Resin and Acrylic Resin Members, the disclosure of which is totally incorporated herein by reference, illustrates a process which comprises providing a flexible belt having at least one welded seam extending from one parallel edge to the other parallel edge, the welded seam having a rough seam region comprising an overlap of two opposite edges; contacting the rough seam region with a heat and pressure applying tool; and smoothing out the rough seam region with heat and pressure applied by the heat and pressure applying tool to produce a flexible belt having a smooth welded seam, and subsequently coating the seam with a resin mixture of a glycoluril resin and an acrylic resin.

Illustrated in copending U.S. application Ser. No. 12/360,335, now U.S. Pat. No. 8,057,973, filed Jan. 27, 2009, the disclosure of which is totally incorporated herein by reference, is a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a nano diamond component.

There is disclosed in copending U.S. application Ser. No. 11/729,622, Publication No. 2008024172, now U.S. Pat. No. 7,662,525, filed Mar. 29, 2007, entitled Anticurl Backside Coating (ACBC) Photoconductors, a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a polymer and needle shaped particles with an aspect ratio of from 2 to about 200.

U.S. application Ser. No. 12/033,247, now U.S. Pat. No. 7,771,908, filed Feb. 19, 2008, entitled Anticurl Backside Coating (ACBC) Photoconductors, the disclosure of which is totally incorporated herein by reference, discloses a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a fluorinated poly(oxetane) polymer.

U.S. application Ser. No. 12/033,279, now U.S. Pat. No. 7,781,133, filed Feb. 19, 2008, entitled Backing Layer Containing Photoconductor, the disclosure of which is totally incorporated herein by reference, illustrates a photoconductor comprising a substrate, an imaging layer thereon, and a backing layer located on a side of the substrate opposite the imaging layer wherein the outermost layer of the backing layer adjacent to the substrate is comprised of a self crosslinked acrylic resin and a crosslinkable siloxane component.

BACKGROUND

This disclosure is generally directed to photoreceptors, photoconductors, and the like. More specifically, the present disclosure is directed to multilayered drum, or flexible belt imaging members, or devices comprised of a first layer, which first layer, in embodiments, is comprised of a glycoluril resin and an acrylic resin, such as a self crosslinking acrylic resin, and also where a catalyst can be included in the resin mixture to assist in crosslinking the mixture components, and where the first layer, in embodiments, is referred to as a backside coating layer or curl deterring backside coating layer (ACBC), and which layer is in contact with and contiguous to the reverse side of the supporting substrate, that is this side of the substrate that is not in contact with the photogenerating layer; a supporting medium like a substrate, a photogenerating layer, and a charge transport layer, including a plurality of charge transport layers, such as a first charge transport layer and a second charge transport layer, an optional adhesive layer, an optional hole blocking or undercoat layer, and an optional overcoat layer, and wherein the supporting substrate is situated between the first layer and the photogenerating layer. More specifically, the photoconductors disclosed in embodiments enable a number of advantages, such as permit acceptable anticurl characteristics in combination with excellent conductivity, prolonged wear, excellent bulk conductivity, acceptable friction coefficient characteristics, for example a lower friction coefficient than a comparable photoconductor that is free of the resin mixture disclosed herein; an ACBC layer with almost 100 percent transmission enabling imaging from the back of the photoconductor; a dispersion formation is avoided which can cause manufacturing difficulties, and non-uniformity; the conductivity of the resin mixture ACBC layer is substantially uniform and reproducible; excellent surface slipperiness, and scratch resistant characteristics; wear resistance properties; and minimal agglomeration of the ACBC mixture components.

While not being desired to be limited by theory, it is believed that the ACBC layer components provide a conductive matrix and permit the transmission of light. The aforementioned transparency of, for example, about 90 to about 100 percent allows for excellent photoreceptor applications since the erase illumination is applied from inside the belt module and passes through the ACBC layer into the photogenerating layer. The electrical conductivity of the ACBC layer allows the triboelectrically generated charges to move through the layer, and discharge before the quantity of charge builds up to significant levels.

In some instances, when a flexible layered photoconductor belt is mounted over a belt support module comprising various supporting rollers and backer bars present in a xerographic imaging apparatus, the anticurl or reduction in curl backside coating (ACBC), functioning under a normal xerographic machine operation condition, is repeatedly subjected to mechanical sliding contact against the apparatus backer bars and the belt support module rollers to thereby adversely impact the ACBC wear characteristics.

Moreover, with a number of known prior art ACBC photoconductor layers the mechanical interactions against the belt support module components can decrease the lifetime of the photoconductor primarily because of wear and degradation after short time periods. Belt modules that incorporate large numbers of sliding positioning supports generate a large amount of electric charge from the sliding contact which needs to be discharged by the costly combination of carbon fiber brush and a bias power supply. Failure to discharge the ACBC produces a large electrostatic attractive force between the photoreceptor and the support element which increases the normal force producing more drag which complicates photoreceptor belt removal, and can become large enough to stall the drive motor. In addition, the multiple points of sliding contact generate a significant quantity of fine polymer dust which coats the machine components and acts as a lubricant, reducing drive roller capacity. Drive capacity is restored by having a technician or a customer devote time to the solvent cleaning all the rollers and backer bars each time a photoreceptor belt is changed. These and other disadvantages are eliminated or minimized with the photoconductors of the present disclosure.

In embodiments, the photoconductors disclosed include an ACBC (anticurl back coating) layer on the reverse side of the supporting substrate of a belt photoreceptor. The ACBC layer, which can be solution coated, for example, as a self-adhesive layer on the reverse side of the substrate of the photoconductor, comprises known glycoluril and acrylic resin mixtures, and where the mixture is crosslinked, and that, for example, substantially reduces surface contact friction, and prevents or minimizes wear/scratch problems for the photoreceptor device. In embodiments, the mechanically robust ACBC layer of the present disclosure usually will not substantially reduce the layer's thickness over extended time periods adversely affecting its anticurl ability for maintaining effective imaging member belt flatness while minimizing the formation of dirt and debris.

Moreover, high surface contact friction of the backside coating against machines, such as xerographic printers, and its subsystems can cause the development of undesirable electrostatic charge buildup. In a number of instances, with devices, such as printers, the electrostatic charge builds up because of high contact friction between the anticurl backside coating and the backer bars which increases the frictional force to the point that it requires higher torque from the driving motor to pull the belt for effective cycling motion. In a full color electrophotographic apparatus using a 10-pitch photoreceptor belt, this electrostatic charge buildup can be high due to the large number of backer bars used in the machine.

The backside coating layers illustrated herein, in embodiments, have excellent wear resistance, extended lifetimes, minimal charge buildup, excellent bulk conductivity, and permit the elimination or minimization of photoconductive imaging member belt ACBC scratches.

Also included within the scope of the present disclosure are methods of imaging and printing with the photoresponsive or photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the toner image to a suitable image receiving substrate, and permanently affixing the image thereto. In those environments wherein the device is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital and/or color printing, are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

Anticurl backside coating formulations are disclosed in U.S. Pat. Nos. 5,069,993; 5,021,309; 5,919,590; and 4,654,284. However, there is a need to create an anticurl backside coating formulation that has intrinsic properties that minimize or eliminate charge accumulation in photoconductors without sacrificing other electrical properties and allowing low surface energy characteristics. One known ACBC design can be designated as an insulating polymer coating containing additives, such as silica, PTFE or TEFLON®, to reduce friction against backer plates and rollers, but these additives tend to charge up triboelectrically due to their rubbing against the plates resulting in an electrostatic drag force that adversely affects the process speed of the photoconductor.

Photoconductors containing ACBC layers are illustrated in U.S. Pat. Nos. 5,096,795; 5,935,748; 6,303,254; 6,528,226; and 6,939,652.

Belt modules that incorporate large numbers of sliding positioning supports like in known production xerographic printing machines generate a large amount of electric charge from the sliding contact that is discharged by the use of a somewhat costly combination of a carbon fiber brush and a bias power supply. Failure to discharge the ACBC produces an electrostatic attractive force between the photoreceptor and the support element which increases the normal force producing more drag which complicates photoreceptor belt removal and can become large enough to stall or render inoperative the drive motor. In addition, the multiple points of sliding contact generate a significant quantity of fine polymer dust which coats the machine components and acts as a lubricant, reducing drive roller capacity.

Layered photoresponsive imaging members have been described in numerous U.S. patents, such as U.S. Pat. No. 4,265,990.

In U.S. Pat. No. 4,587,189, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members or photoconductors of the present disclosure in embodiments thereof.

Illustrated in U.S. Pat. No. 5,521,306 is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811 is a process for the preparation of hydroxygallium phthalocyanine photogenerating pigments which comprises as a first step hydrolyzing a gallium phthalocyanine precursor pigment by dissolving the hydroxygallium phthalocyanine in a strong acid, and then reprecipitating the resulting dissolved pigment in basic aqueous media. Also, processes for the preparation of photogenerating pigments of hydroxygallium phthalocyanine are illustrated in U.S. Pat. No. 5,473,064, the disclosure of which is totally incorporated herein by reference.

The appropriate components, such as the supporting substrates, the photogenerating layer components, the charge transport layer components, the overcoating layer components, and the like, of the above-recited patents may be selected for the photoconductors of the present disclosure in embodiments thereof.

SUMMARY

Disclosed are imaging members containing a mechanically robust ACBC layer that possesses many of the advantages illustrated herein, such as extended lifetimes of the ACBC photoconductor such as, for example, in excess, it is believed, of about 1,000,000 simulated xerographic imaging cycles, and which photoconductors are believed to exhibit ACBC wear and scratch resistance characteristics.

Also disclosed are photoconductors containing a slippery and conductive layer that minimizes charge accumulations.

Additionally disclosed are flexible belt imaging members comprising the disclosed ACBC, and an optional hole blocking layer or layers comprised of, for example, aminosilanes, metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

EMBODIMENTS

In aspects thereof, there is illustrated herein a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a crosslinked mixture of a glycoluril resin and an acrylic resin or polymer, such as a self crosslinking acrylic resin; a photoconductor comprised in sequence of an anticurl charge blocking layer comprised of a mixture of a glycoluril resin, and a self crosslinking acrylic resin; a supporting substrate, a photogenerating layer thereover, and a charge transport layer; a photoconductor comprised in sequence of a first layer comprised of a mixture of a glycoluril resin and a self crosslinking acrylic resin; a second supporting substrate layer; a photogenerating third layer thereover, and a charge transport layer, and wherein the glycoluril resin is represented by

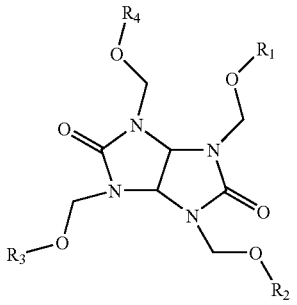

wherein R is alkyl or hydrogen, where alkyl contains from 1 to about 10 carbon atoms, and the mixture of resins have, for example, a crosslinking percentage of from about 65 to about 95; a photoconductor comprising a first layer, a flexible supporting substrate thereover, a photogenerating layer, and at least one charge transport layer comprised of at least one charge transport component, and wherein the first layer, which is an anticurl backside coating (ACBC) that minimizes curl, is in contact with the supporting substrate on the reverse side thereof, and which first layer is comprised of a mixture of a glycoluril polymer or resin, and a self crosslinking acrylic resin, as illustrated in copending U.S. application Ser. No. 12/550,486, now U.S. Pat. No. 4,084,112, filed Aug. 31, 2009, the disclosure of which is totally incorporated herein by reference, a process which comprises providing a flexible belt having at least one welded seam extending from one parallel edge to the other parallel edge, the welded seam having a rough seam region comprising an overlap of two opposite edges; contacting the rough seam region with a heat and pressure applying tool; and smoothing out the rough seam region with heat and pressure applied by the heat and pressure applying tool to produce a flexible belt having a smooth welded seam, and subsequently coating the seam with a resin mixture of a glycoluril resin and an acrylic resin.

In embodiments, there is disclosed a photoconductor comprising a first ACBC layer, a second supporting substrate layer thereover, a photogenerating third layer, and at least one charge transport layer comprised of at least one charge transport component, and wherein the first layer is in contact with the supporting substrate on the reverse side thereof, that is the side of the supporting substrate free of contact with the supporting substrate layer; a photoconductor comprised in sequence of a supporting substrate, a photogenerating layer thereover, and a charge transport layer, and wherein the substrate includes on the reverse side or the side not in contact with the supporting substrate thereof an ACBC layer as disclosed herein; and a photoconductor comprised in sequence of a supporting substrate, a photogenerating layer thereover, and a hole transport layer, and wherein the substrate includes on the reverse side an ACBC layer, and more specifically, where the photogenerating layer is in contact with the surface of the supporting substrate, and the ACBC layer is in contact with the supporting substrate opposite the surface.

The anticurl backside coating layer possesses a thickness of, for example, from about 1 to about 100 microns, from about 5 to about 50 microns, from about 5 to about 10 microns, or from about 10 to about 30 microns.

ACBC Layer Resin Component Examples

Examples of the glycoluril resins selected for the ACBC layer are, for example, represented by the following formula/structure

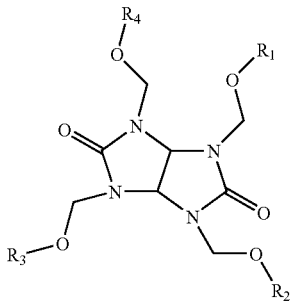

wherein each R substituent independently represents at least one of a hydrogen atom, and an alkyl with, for example, 1 to about 18 carbon atoms, from 1 to about 10 carbon atoms, from 1 to about 8 carbon atoms, or from 1 to about 6 or about 4 carbon atoms.

Examples of the glycoluril resin include unalkylated and highly alkylated glycoluril resins like CYMEL® and POWDERLINK® glycoluril resins commercially available from CYTEC Industries, Inc. Specific examples of the disclosed glycoluril resin include CYMEL® 1170 (a highly butylated resin with at least 75 percent of the R groups being butyl with the remainder of the R groups being hydrogen; viscosity equal to about 3,000 to about 6,000 centipoise at 23° C.); CYMEL® 1171 (a highly methylated-ethylated with at least 75 percent of the R groups being methyl/ethyl and the remainder of the R groups being hydrogen, viscosity is equal to about 3,800 to about 7,500 centipoise at 23° C.); CYMEL® 1172 (an unalkylated resin with the R groups being hydrogen); and POWDERLINK® 1174 (a highly methylated resin with at least 75 percent of the R groups being methyl and the remainder of the R groups being hydrogen, a solid at 23° C.).

The number average molecular weight of the glycoluril resin is, for example, from about 200 to about 1,000, or from about 250 to about 600. The weight average molecular weight of the glycoluril resin is, for example, from about 230 to about 3,000, or from about 280 to about 1,800. The weight average and number average molecular weights are determined by known methods such as x-ray analysis and chromatography.

Examples of the selected acrylic resin, and more specifically, a self crosslinked acrylic resin, that is for example, where a crosslinking component is avoided, and crosslinking is accomplished by heating, include the resin DORESCO® TA22-8, available from Lubrizol Dock Resins, Linden, N.J., and substantially free of any conductive components dispersed within. By the addition of a small amount of an acid catalyst, the self crosslinking acrylic resin further crosslinks upon thermal curing at temperatures of, for example, from about 80° C. to about 200° C. for a suitable time period, such as for example, from about 1 to about 60 minutes, and more specifically, curing at about 160° C. for 20 minutes, resulting in a mechanically robust crosslinked acrylic resin with a surface resistivity of from about $10^9$ to about $10^{13}$ ohm/sq, and specifically about $10^{11}$ ohm/sq. While the percentage of crosslinking can be difficult to determine, and not being desired to be limited by theory, the self crosslinking acrylic resin layer is crosslinked to a suitable value, such as for example, from about 30 to about 100 percent, and from about 50 to about 95 percent.

In embodiments, examples of the self crosslinking acrylic resin selected for the ACBC mixture has, for example, a weight average molecular weight ($M_w$) of from about 100,000 to about 500,000, or from about 120,000 to about 200,000; a polydispersity index (PDI) ($M_w/M_n$) of from about 1.5 to about 4, or from about 2 to about 3; and a surface resistivity (at, for example, 20° C. and 50 percent humidity) of from about $10^8$ to about $10^{14}$ ohm/sq, or from about $10^9$ to about $10^{12}$ ohm/sq. A specific example of a self crosslinking acrylic resin selected for the ACBC layer includes DORESCO® TA22-8, 30 weight percent solids, and a glass transition temperature of about 79° C., as obtained from Lubrizol Dock Resins, Linden, N.J., which resin in one form possesses, it is believed, a weight average molecular weight of about 160,000, a polydispersity index of about 2.3, and a surface resistivity (20° C. and 50 percent humidity) of about $10^{11}$ ohm/sq, DORESCO® TA22-51, obtained from Lubrizol Dock Resins, Linden, N.J., which resin possesses a lower crosslinking density upon thermal cure as compared with DORESCO® TA22-8 resin.

By the addition of an acid catalyst to assist in crosslinking, the mixture of the glycoluril resin and the self crosslinking acrylic resin crosslinks upon thermal curing at temperatures of, for example, from about 80° C. to about 200° C. for a suitable time period, such as for example, from about 1 to about 60 minutes, and more specifically, curing at about 160° C. for 20 minutes, resulting in a mechanically robust mixture of a crosslinked glycoluril resin and acrylic resin layer with a surface resistivity of from about $10^7$ to about $10^{13}$ ohm/sq. While the percentage of crosslinking can be difficult to determine, and not being desired to be limited by theory, the mixture of the glycoluril resin and the crosslinked resin layer is crosslinked to a suitable value, such as for example, from about 50 to about 100 percent, from about 60 to about 95 percent, or from about 75 to about 90 percent.

Nonlimiting examples of catalysts selected for the crosslinking of the polymeric mixture of a glycoluril resin, and the self crosslinking acrylic resin include oxalic acid, maleic acid, carboxylic acid, ascorbic acid, malonic acid, succinic acid, tartaric acid, citric acid, p-toluenesulfonic acid, methanesulfonic acid, and the like, and mixtures thereof. A typical concentration of the acid catalyst selected is, for example, from about 0.01 to about 5 weight percent, about 0.5 to about 4 weight percent, and about 1 to about 3 weight percent based on the weight of the mixture of a glycoluril resin, and the self crosslinking acrylic resin.

Self crosslinking acrylic resin refers, for example, to this resin being crosslinked simply by heating and, in embodiments, where a catalyst can be selected to assist in the crosslinking. In addition the glycoluril and acrylic resin mixture crosslinks, especially in the presence of a catalyst.

The thickness of the ACBC layer comprised of the mixture of a glycoluril resin and a self crosslinking acrylic resin can vary; for example, this thickness can be from about 1 to about 100 microns, from about 5 to about 50 microns, from about 5 to about 10 microns, or from about 10 to about 30 microns.

Examples of additional components present in the ACBC layer are a number of known polymers and conductive components.

Thus, the anticurl backside coating (ACBC) layer may further comprise at least one polymer, which usually is the same polymer that is selected for the charge transport layer or layers. Examples of polymers present, for example, in an amount of from about 1 to about 99 weight percent, from about 10 to about 80 weight percent, or from 30 to about 50 weight percent of the ACBC layer, include polycarbonates, polyarylates, acrylate polymers, vinyl polymers, cellulose polymers, polyesters, copolyesters, polysiloxanes, polyamides, polyurethanes, poly(cyclo olefins), epoxies, and copolymers thereof; and more specifically, polycarbonates such as poly(4,4'-isopropylidene-diphenylene)carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, the polymeric binder is comprised of a polycarbonate resin with a weight average molecular weight of, for example, from about 20,000 to about 100,000, and more specifically, with a molecular weight $M_w$ of from about 50,000 to about 100,000.

A blocking agent can also be included in the ACBC layer, which agent can "tie up" or substantially block the acid catalyst effect to provide solution stability until the acid catalyst function is initiated. Thus, for example, the blocking agent can block the acid effect until the solution temperature is raised above a threshold temperature. For example, some blocking agents can be used to block the acid effect until the solution temperature is raised above about 100° C. At that time, the blocking agent dissociates from the acid and vaporizes. The unassociated acid is then free to catalyze the polymerization. Examples of such suitable blocking agents include, but are not limited to, pyridine and commercial acid solutions containing blocking agents, such as CYCAT® 4045, available from Cytec Industries Inc.

The ACBC layer further comprises a soluble siloxane or a fluoro component for enhanced slipperiness and lower friction coefficient. When incorporated, the siloxane or fluoro component, in embodiments, crosslinks together with the glycoluril resin and the acrylic resin mixture. In embodiments, the siloxane or fluoro component is present in an amount of from about 0.5 to about 20 weight percent, from about 1 to about 10 weight percent, or from about 2 to about 5 weight percent of the total ACBC layer solid.

Examples of the siloxane component include hydroxyl derivatives of silicone modified polyacrylates such as BYK-SILCLEAN® 3700; polyether modified acryl polydimethylsiloxanes such as BYK-SILCLEAN® 3710; and polyether modified hydroxyl polydimethylsiloxanes such as BYK-SILCLEAN® 3720. BYK-SILCLEAN® is a trademark of BYK. Examples of the fluoro component include (1) hydroxyl derivatives of perfluoropolyoxyalkanes such as FLUOROLINK® D (M.W. of about 1,000 and a fluorine content of about 62 percent), FLUOROLINK® D10-H (M.W. of about 700 and fluorine content of about 61 percent), and FLUOROLINK® D10 (M.W. of about 500 and fluorine content of about 60 percent) (functional group —$CH_2OH$); FLUOROLINK® E (M.W. of about 1,000 and a fluorine content of about 58 percent), and FLUOROLINK® E10 (M.W. of about 500 and fluorine content of about 56 percent) (functional group —$CH_2(OCH_2CH_2)_nOH$); FLUOROLINK® T (M.W. of about 550 and fluorine content of about 58 percent), and FLUOROLINK® T10 (M.W. of about 330 and fluorine content of about 55 percent) (functional group —$CH_2OCH_2CH(OH)CH_2OH$); (2) hydroxyl derivatives of perfluoroalkanes ($R_fCH_2CH_2OH$, wherein $R_f$=$F(CF_2CF_2)_n$) wherein n represents the number of groups, such as about 1 to about 50, such as ZONYL® BA (M.W. of about 460 and fluorine content of about 71 percent), ZONYL® BA-L (M.W. of about 440 and fluorine content of about 70 percent), ZONYL® BA-LD (M.W. of about 420 and fluorine content of about 70 percent), and ZONYL® BA-N (M.W. of about 530 and fluorine content of about 71 percent); (3) carboxylic acid derivatives of fluoropolyethers such as FLUOROLINK® C (M.W. of about 1,000 and fluorine content of about 61 percent); (4) carboxylic ester derivatives of fluoropolyethers such as FLUOROLINK® L (M.W. of about 1,000 and fluorine content of about 60 percent), FLUOROLINK® L10 (M.W. of about 500 and fluorine content of about 58 percent); (5) carboxylic ester derivatives of perfluoroalkanes ($R_fCH_2CH_2O(C{=}O)R$, wherein $R_f$=$F(CF_2CF_2)_n$, and $n$ is as illustrated herein, and R is alkyl) such as ZONYL® TA-N (fluoroalkyl acrylate, R=$CH_2$=CH—, M.W. of about 570 and fluorine content of about 64 percent), ZONYL® TM (fluoroalkyl methacrylate, R=$CH_2$=$C(CH_3)$—, M.W. of about 530 and fluorine content of about 60 percent), ZONYL® FTS (fluoroalkyl stearate, R=$C_{17}H_{35}$—, M.W. of about 700 and fluorine content of about 47 percent), ZONYL® TBC (fluoroalkyl citrate, M.W. of about 1,560 and fluorine content of about 63 percent); (6) sulfonic acid derivatives of perfluoroalkanes ($R_fCH_2CH_2SO_3H$, wherein $R_f$=$F(CF_2CF_2)_n$), and n is as illustrated herein, such as ZONYL® TBS (M.W. of about 530 and fluorine content of about 62 percent); (7) ethoxysilane derivatives of fluoropolyethers such as FLUOROLINK® S10 (M.W. of about 1,750 to about 1,950); (8) phosphate derivatives of fluoropolyethers such as FLUOROLINK® F10 (M.W. of about 2,400 to about 3,100). The FLUOROLINK® additives are available from Ausimont USA, and the ZONYL® additives are available from E.I. DuPont.

Photoconductive Layer Components

There can be selected for the photoconductors disclosed herein a number of known layers, such as substrates, photogenerating layers, charge transport layers, hole blocking layers, adhesive layers, protective overcoat layers, and the like. Examples, thicknesses, specific components of many of these layers include the following.

A number of known supporting substrates can be selected for the photoconductors illustrated herein, such as those substrates that will permit the layers thereover to be effective. The thickness of the photoconductor substrate layer depends on many factors, including economical considerations, electrical characteristics, adequate flexibility, and the like, thus this layer may be of substantial thickness, for example over 3,000 microns, such as from about 1,000 to about 2,000 microns, from about 500 to about 1,000 microns, or from about 300 to about 700 microns, ("about" throughout includes all values in between the values recited) or of a minimum thickness. In embodiments, the thickness of this layer is from about 75 to about 300 microns, or from about 100 to about 150 microns.

The photoconductor substrate may be opaque or substantially transparent, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of a substantial thickness of, for example, up to many centimeters, or of a minimum thickness of less than a millimeter. Similarly, a flexible belt may be of a substantial thickness of, for example, about 250 microns, or of a minimum thickness of less than about 50 microns, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations such as, for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer such as, for example, polycarbonate materials commercially available as MAKROLON®.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer, in embodiments, is dependent primarily upon factors, such as photosensitivity, electrical properties, and mechanical considerations.

The photogenerating composition or pigment is present in the resinous binder composition in various amounts. Generally, however, from about 5 to about 95 percent by volume of the photogenerating pigment is dispersed in about 95 to about 5 percent by volume of the resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly(vinyl butyral), poly (vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium, and alloys of selenium and arsenic, tellurium, germanium, and the like, hydrogenated amorphous silicon, and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder, and fabricated by solvent coating techniques.

In embodiments, examples of polymeric binder materials that can be selected as the matrix for the photogenerating layer are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene-butadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent coated layer may be effected by any known conventional techniques such as oven drying, infrared radiation drying, air drying, and the like.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer, and the photogenerating layer. Usually, the photogenerating layer is applied onto the blocking layer, and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary, and in embodiments is, for example, from about 0.05 (500 Angstroms) to about 0.3 micron (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an adhesive layer usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure, further desirable electrical and optical properties.

The optional hole blocking or undercoat layer for the imaging members of the present disclosure can contain a number of components including known hole blocking components, such as amino silanes, doped metal oxides, a metal oxide like titanium, chromium, zinc, tin, and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 to about 80 weight percent, and more specifically, from about 55 to about 65 weight percent of a suitable component like a metal oxide, such as $TiO_2$, from about 20 to about 70 weight percent, and more specifically, from about 25 to about 50 weight percent of a phenolic resin; from about 2 to about 20 weight percent, and more specifically, from about 5 to about 15 weight percent of a phenolic compound preferably containing at least two phenolic groups, such as bisphenol S, and from about 2 to about 15 weight percent, and more specifically, from about 4 to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant, followed by mixing. The hole blocking layer coating dispersion can be applied by dip coating or web coating, and the layer can be thermally cured after coating. The hole blocking layer resulting is, for example, of a thickness of from about 0.01 to about 30 microns, and more specifically, from about 0.1 to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol, and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer), and the underlying conductive surface of substrate may be selected.

A number of charge transport compounds can be included in the charge transport layer, which layer generally is of a thickness of from about 5 to about 75 microns, and more specifically, of a thickness of from about 10 to about 40 microns. Examples of charge transport components are aryl amines as represented by

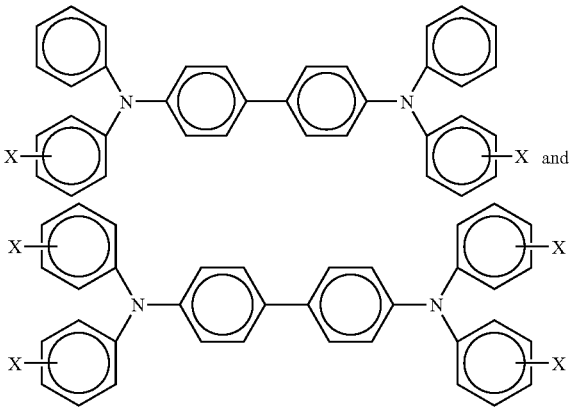

wherein X is a suitable hydrocarbon like alkyl, alkoxy, aryl, and derivatives thereof; a halogen, or mixtures thereof, and especially those substituents selected from the group consisting of Cl and $CH_3$; and components as represented by

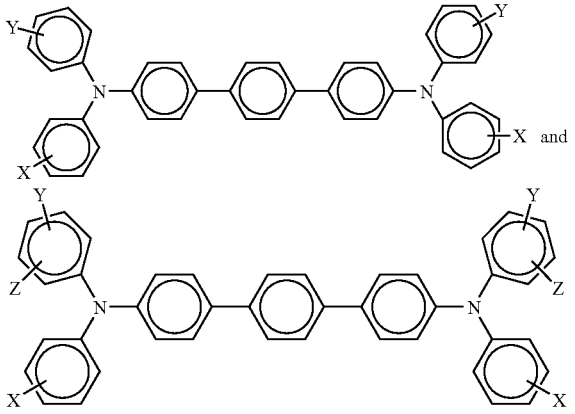

wherein X, Y and Z are independently alkyl, alkoxy, aryl, a halogen, or mixtures thereof; and wherein at least one of Y and Z are present. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific charge transport components include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like. Other known charge transport layer molecules can be selected, reference for example, U.S. Pat. Nos. 4,921,773 and 4,464,450, the disclosures of which are totally incorporated herein by reference.

In embodiments, the charge transport component can be represented by

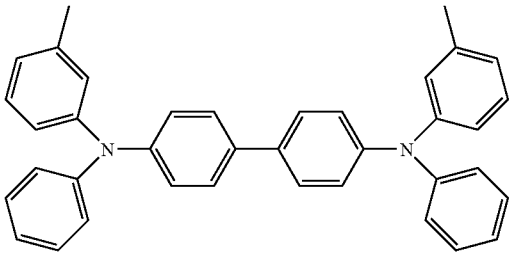

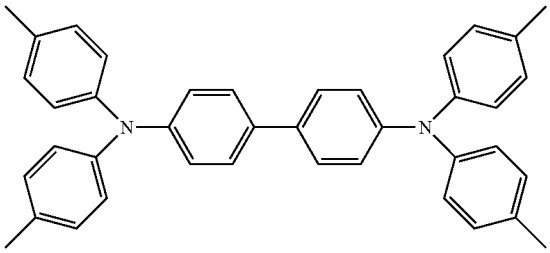

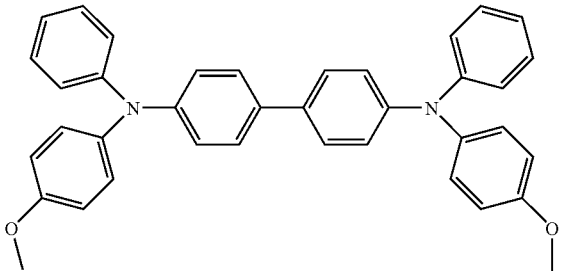

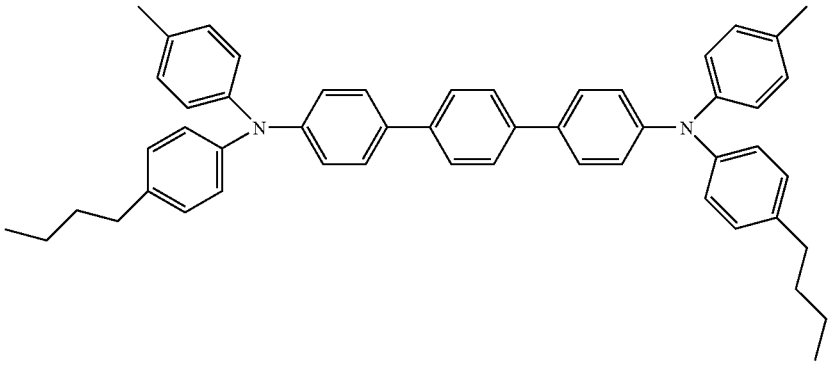

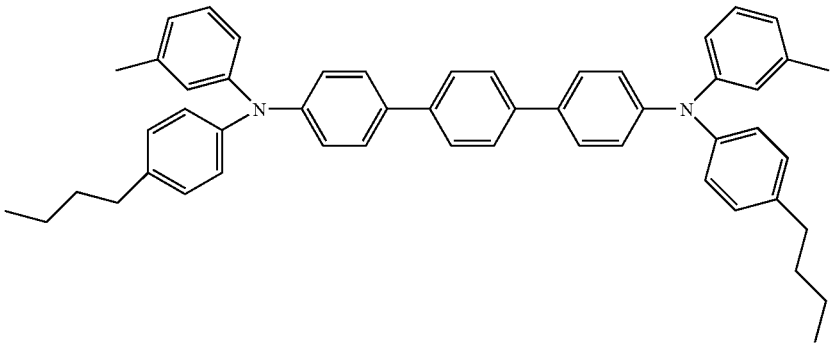

and

-continued

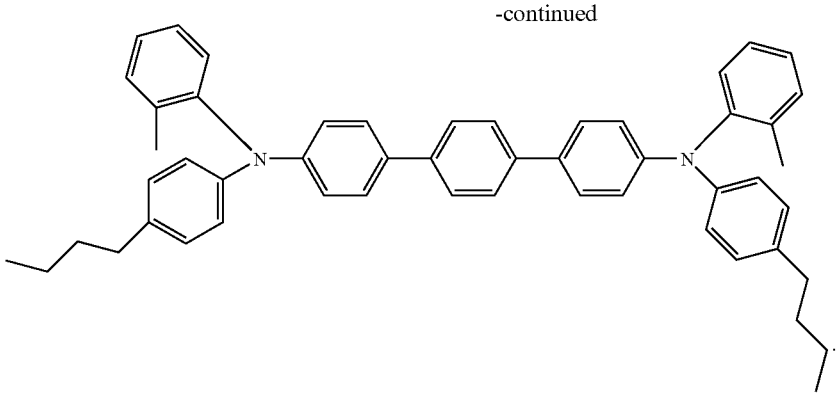

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 to about 50 percent by weight of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, "charge transport" refers, for example, to charge transporting molecules as a monomer that allows the free charge generated in the photogenerating layer to be transported across the transport layer.

Examples of the charge transport hole transporting molecules present, for example, in an amount of from about 50 to about 75 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine; hydrazones such as N-phenyl-N-methyl-3-(9-ethyl) carbazyl hydrazone, and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, N,N'-bis (4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the charge transport layer may comprise a polymeric charge transport material, or a combination of a small molecule charge transport material and a polymeric charge transport material.

Examples of components or materials optionally incorporated into the charge transport layers or at least one charge transport layer to, for example, enable excellent lateral charge migration (LCM) resistance include hindered phenolic antioxidants, such as tetrakis methylene (3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

A number of processes may be used to mix and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each charge transport layer, in embodiments, is from about 10 to about 70 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation, and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported to selectively discharge a surface charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like. An optional top overcoating layer, such as the overcoating of copending U.S. application Ser. No. 11/593,875, Publication No. 20080107985, the disclosure of which is totally incorporated herein by reference, may be applied over the charge transport layer to provide abrasion protection.

Aspects of the present disclosure relate to a photoconductive imaging member comprised of a first ACBC layer as illustrated herein, a supporting substrate, a photogenerating layer, a charge transport layer, and an overcoating charge transport layer; a photoconductive member with a photogenerating layer of a thickness of from about 0.1 to about 10 microns, and at least one transport layer, each of a thickness of from about 5 to about 100 microns; an imaging method and an imaging apparatus containing a charging component, a development component, a transfer component, and a fixing component, and wherein the apparatus contains a photoconductive imaging member comprised of a first ACBC layer, a supporting substrate, and thereover a layer comprised of a photogenerating pigment and a charge transport layer or layers, and thereover an overcoat charge transport layer, and where the transport layer is of a thickness of from about 20 to about 75 microns; a member wherein the photogenerating layer contains a photogenerating pigment present in an amount of from about 5 to about 95 weight percent; a member wherein the thickness of the photogenerating layer is from about 0.1 to about 4 microns; a photoconductor wherein the photogenerating layer contains photogenerating pigment and a polymer binder; a member wherein the photogenerating binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein each of the charge transport layers, such as 1, 2, or 3 layers, and especially 2 layers, comprises

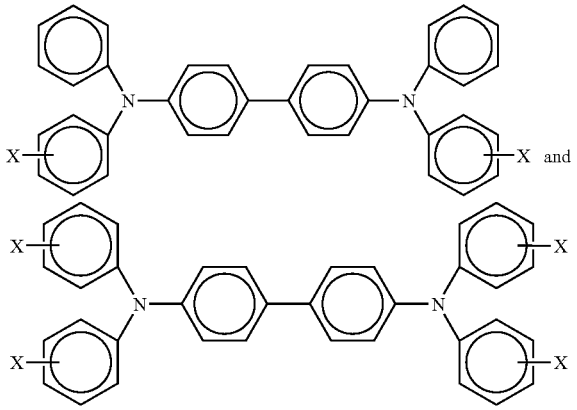

wherein X is selected from the group consisting of alkyl, alkoxy, aryl, and halogen, and more specifically, methyl and halo; an imaging member wherein alkyl and alkoxy contains from about 1 to about 12 carbon atoms; an imaging member wherein alkyl contains from about 1 to about 7 carbon atoms; an imaging member wherein alky is methyl; an imaging member wherein each of, or at least one of the charge transport layers comprises

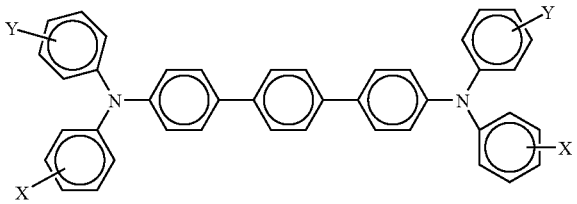

wherein X and Y are independently alkyl, alkoxy, aryl, a halogen, or mixtures thereof; an imaging member wherein alkyl and alkoxy contains from about 1 to about 12 carbon atoms; an imaging member wherein alkyl contains from about 1 to about 5 carbon atoms, and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2) theta+/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member developing the latent image, and transferring the developed electrostatic image to a suitable substrate; a method of imaging wherein the imaging member is exposed to light of a wavelength of from about 370 to about 950 nanometers; a photoconductive member wherein the photogenerating layer is situated between the substrate and the charge transport layer; a member wherein the charge transport layer is situated between the substrate and the photogenerating layer; a member wherein the photogenerating layer is of a thickness of from about 0.1 to about 50 microns; a member wherein the photogenerating component pigment amount is from about 0.5 to about 20 weight percent, and wherein the photogenerating pigment is optionally dispersed in from about 1 to about 80 weight percent of a polymer binder; a member wherein the binder is present in an amount of from about 50 to about 90 percent by weight, and wherein the total of the layer components is about 100 percent; an imaging member wherein the photogenerating component is Type V hydroxygallium phthalocyanine, or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a photogenerating layer, a hole transport layer and a top overcoating layer in contact with the hole transport layer or in embodiments in contact with the photogenerating layer, and in embodiments wherein a plurality of charge transport layers are selected, such as for example, from two to about ten, and more specifically, two may be selected; and a photoconductive imaging member comprised of an optional supporting substrate, a photogenerating layer, and a first, second, and third charge transport layer. In embodiments, at least one charge transport layer refers, for example, to 1, 2, 3, 4, 5, 6, or 7 layers, and especially 1 or 2 layers, and yet more specifically, 2 layers.

The following Examples are being submitted to illustrate embodiments of the present disclosure.

Comparative Example 1

A belt photoconductor was prepared as follows.

There was coated a 0.02 micron thick titanium layer on the biaxially oriented polyethylene naphthalate substrate (KALEDEX™ 2000) having a thickness of 3.5 mils, and applying thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 500 Angstroms. An adhesive layer was then prepared by applying a wet coating over the blocking layer using a gravure applicator or an extrusion coater, and which adhesive contained 0.2 percent by weight based on the total weight of the solution of the copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer. The resulting adhesive layer had a dry thickness of 200 Angstroms.

A photogenerating layer dispersion was prepared by introducing 0.45 gram of the known polycarbonate IUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the known ground strip layer that was applied later. The photogenerating layer was dried at 120° C. for 1 minute in a forced air oven to form a dry photogenerating layer having a thickness of 0.4 micron.

The photoconductor imaging member web was then coated with two charge transport layers. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and poly(4,4'-isopropylidene diphenyl)carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process, the humidity was equal to or less than 15 percent.

An anticurl backside coating layer (ACBC) coating solution was prepared by introducing into an amber glass bottle in a weight ratio of 8:92 VITEL® 2200, a copolyester of iso/terephthalic acid, dimethylpropanediol, and ethanediol having a melting point of from about 302° C. to about 320° C., commercially available from Shell Oil Company, Houston, Tex., and MAKROLON® 5705, a known polycarbonate resin having a $M_w$ molecular weight average of from about 50,000 to about 100,000, commercially available from Farbenfabriken Bayer A.G. The resulting mixture was then dissolved in methylene chloride to form a solution containing 9 percent by weight solids. This solution was applied on the back of the above KALEDEX™ 2000 substrate of the belt photoconductor to form a coating of the anticurl backside coating layer of VITEL® 2200/MAKROLON® 5705 at a ratio of 8/92 that upon drying (120° C. for 1 minute) had a thickness of 17.4 microns. During this coating process, the humidity was about 15 percent.

Example I

A photoconductor was prepared by repeating the process of Comparative Example 1 except that the ACBC layer coating solution was prepared by introducing into an amber glass bottle in a weight ratio of 66/33/1 CYMEL® 1170, a highly methylated-ethylated glycoluril resin, represented by

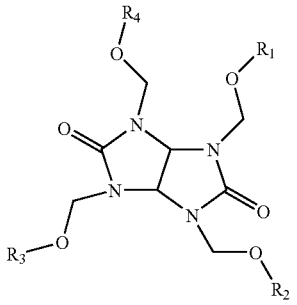

with at least 75 percent of the R groups being methyl/ethyl, and the remainder of the R groups being hydrogen, with a viscosity of from about 3,800 to about 7,500 centipoise at 23° C., commercially available from CYTEC Industries, Inc; DORESCO® TA22-8, a self crosslinking acrylic resin solution in ethanol/acetone (about 30 weight percent solid) obtained from Lubrizol Dock Resins, and with a glass transition temperature of 79° C.; and p-toluenesulfonic acid (pTSA), an acid catalyst. The resulting mixture was then dissolved in DOWANOL™ to form a solution containing about 15 percent by weight solids.

The resulting ACBC layer mixture was crosslinked to about 90 percent upon thermal curing at 160° C. for 5 minutes, resulting in a 14.5 micron thick mechanically robust crosslinked polymeric layer comprised of CYMEL® 1170/DORESCO® TA22-8/pTSA with a ratio of 66/33/1.

Example II

The above process of Example I was repeated except that the ACBC layer was comprised of CYMEL® 1170/DORESCO® TA22-8/pTSA in a ratio of 49.5/49.5/1.

Example III

The above process of Example I was repeated except that the ACBC layer was comprised of CYMEL® 1170/DORESCO® TA22-8/pTSA in a ratio of 33/66/1.

Surface resistivity Measurement

The ACBC layers of the photoconductors of Comparative Examples 1, and Examples I, II and III were measured for surface resistivity (under 500V, averaging four to six measurements at varying spots, 72° F./65 percent room humidity) using a High Resistivity Meter (Hiresta-Up MCP-HT450 from Mitsubishi Chemical Corp.), and the results are provided in Table 1.

TABLE 1

| ACBC Layer | Surface Resistivity (Ohm/sq) |
|---|---|
| Comparative Example 1 | $10^{16}$ |
| Example I | $3.4 \times 10^{7}$ |
| Example II | $1.6 \times 10^{8}$ |
| Example III | $2.1 \times 10^{9}$ |

With the crosslinked resin mixture of Examples I, II and III, the disclosed ACBC layers were less resistive than the controlled Comparative Example 1 ACBC layer. Specifically, the resistivity of the Example I ACBC layer comprising about 66 weight percent of the glycoluril resin was about 9 orders of magnitude lower; the resistivity of the Example II ACBC layer comprising about 49.5 weight percent of the glycoluril resin was about 8 orders of magnitude lower; and the resistivity of the Example III ACBC layer comprising about 33 weight percent of the glycoluril resin was about 7 orders of magnitude lower. It is believed that the ACBC layer components of Examples I, II and III will help eliminate charge buildup at the back of the photoconductor.

Further, the resistivity of the disclosed ACBC layers changed gradually with the glycoluril resin/the self crosslinking acrylic resin ratio. Thus, the surface resistivity changed from about $10^7$ to about $10^9$ ohm/sq when the glycoluril resin/the self crosslinking acrylic resin ratio varied from 66/33 to 33/66 (Table 1).

The conductive ACBC layer of Examples I, II and III should enable elimination of the active power supply that is now used to discharge the back of the belt in the Xerox Corporation iGEN3® printer enabling, for example, a cost savings. Also, there are only a number of approved solvents that can be used to clean the backer bars in xerographic systems. Further, when the bars are inadvertently cleaned with the materials used to clean some of the xerographic fuser parts, the sign of the triboelectrically generated charge changes, and drag forces and belt steering issues. The photoconductors of the above Examples I, II, and III conductive ACBC layer should eliminate or minimize the aforementioned disadvantages.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor consisting of an anticurl backside coating first layer, a supporting substrate thereover, a photogenerating layer, and at least one charge transport layer consisting of at least one charge transport component, and wherein said first layer is in contact with said supporting substrate on the reverse side thereof, and which first layer consists of an optional acid catalyst, a crosslinked mixture of a glycoluril resin and a self crosslinking acrylic resin and wherein said mixture of resins has a crosslinking percentage of from about 65 to about 95 percent and an optional polymer.

2. A photoconductor in accordance with claim 1 wherein said mixture of said glycoluril resin and said acrylic resin consists of from about 1 to about 99 weight percent of said glycoluril resin, and from 99 to about 1 weight percent of said acrylic resin, and wherein the total thereof is about 100 percent and said at least charge transport layer is one, two, or three layers.

3. A photoconductor in accordance with claim 1 wherein said mixture of said glycoluril resin and said acrylic resin consists of from about 15 to about 85 weight percent of said glycoluril resin, and from 85 to about 15 weight percent of said acrylic resin, and wherein the total thereof is about 100 percent, and said at least charge transport layer is one, or two layers, and said crosslinking percentage from about 75 to about 90 percent.

4. A photoconductor in accordance with claim 1 wherein said glycoluril resin further comprises a glycoluril represented by

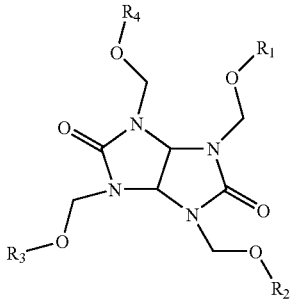

wherein each R group is at least one of hydrogen and alkyl.

5. A photoconductor in accordance with claim 4 wherein R is alkyl.

6. A photoconductor in accordance with claim 4 where R is hydrogen.

7. A photoconductor in accordance with claim 4 where alkyl contains from 1 to about 12 carbon atoms.

8. A photoconductor in accordance with claim 4 where alkyl contains from 1 to 6 carbon atoms.

9. A photoconductor in accordance with claim 4 wherein said glycoluril resin possesses a number average molecular weight of from about 200 to about 1,000, and a weight average molecular weight of from about 230 to about 3,000, and each R group is alkyl with from about 1 to about 4 carbon atoms.

10. A photoconductor in accordance with claim 4 wherein said glycoluril resin possesses a number average molecular weight of from about 250 to about 600, and a weight average molecular weight of from about 280 to about 1,800, and each R is n-butyl, isobutyl, methyl, or ethyl.

11. A photoconductor in accordance with claim 1 wherein said acrylic resin possesses a bulk resistivity of from about $10^8$ to about $10^{14}$ ohm/sq, said at least charge transport layer is one, or two layers, and said crosslinking percentage is from about 75 to about 90 percent.

12. A photoconductor in accordance with claim 1 wherein said acrylic resin possesses a bulk resistivity at about 20° C., and at about 50 percent relative humidity of from about $10^9$ to about $10^{12}$ ohm/sq, and said at least one charge transport layer is one, two, or three layers.

13. A photoconductor in accordance with claim 1 wherein said acrylic resin possesses a weight average molecular weight ($M_w$) of from about 100,000 to about 500,000, and a polydispersity index (PDI) ($M_w/M_n$) of from about 1.5 to about 4.

14. A photoconductor in accordance with claim 1 wherein said acrylic resin possesses a weight average molecular weight ($M_w$) of from about 120,000 to about 200,000, and a polydispersity index (PDI) ($M_w/M_n$) of from about 2 to about 3.

15. A photoconductor in accordance with claim 1 wherein said acrylic resin is crosslinked by heating.

16. A photoconductor in accordance with claim 1 wherein said acid catalyst is present and is selected in an amount of from about 0.1 to about 2 weight percent of total solids.

17. A photoconductor in accordance with claim 12 wherein said acid catalyst is a toluenesulfonic acid.

18. A photoconductor in accordance with claim 1 wherein said crosslinked resin mixture is dispersed in said polymer, and wherein said at least one charge transport layer is 1, 2 or 3 layers.

19. A photoconductor in accordance with claim 18 wherein said polymer is at least one of a polycarbonate, a polyarylate an acrylic, a vinyl polymer, a cellulose polymer, a polyester, a polyamide, a polyurethane, a poly(cyclo olefin), an epoxy resin, and copolymers thereof.

20. A photoconductor in accordance with claim 18 wherein said polymer is a polycarbonate, and wherein said at least one charge transport layer is 1 or 2 layers.

21. A photoconductor in accordance with claim 1 wherein said first layer is located opposite the supporting substrate surface not in contact with the photogenerating layer.

22. A photoconductor in accordance with claim 1 wherein said charge transport component consists of at least one of a

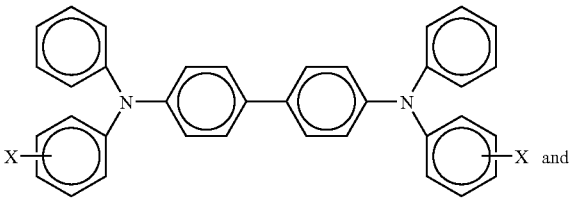

and

-continued

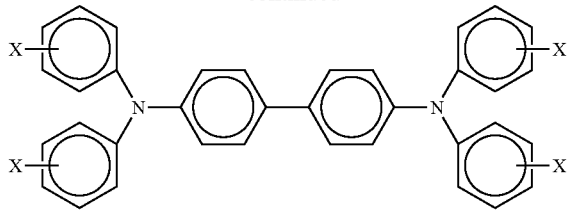

wherein X is selected from the group consisting of at least one of alkyl, alkoxy, aryl, and halogen.

23. A photoconductor in accordance with claim 22 wherein said alkyl and said alkoxy each contains from about 1 to about 12 carbon atoms, and said aryl contains from about 6 to about 36 carbon atoms, and wherein said at least one charge transport layer is 1, or 2 layers.

24. A photoconductor in accordance with claim 22 wherein said charge transport component is an aryl amine of N,N'-diphenyl-N,N-bis(3-methylphenyl)-1,1'-biphenyl-4,4'-diamine.

25. A photoconductor in accordance with claim 1 wherein said charge transport component consists of

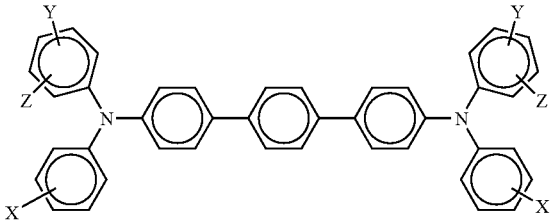

wherein X, Y and Z are independently selected from the group consisting of at least one of alkyl, alkoxy, aryl, and halogen.

26. A photoconductor in accordance with claim 25 wherein said alkyl and alkoxy each contains from about 1 to about 12 carbon atoms, and said aryl contains from about 6 to about 36 carbon atoms.

27. A photoconductor in accordance with claim 1 wherein said charge transport component is selected from the group consisting of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and mixtures thereof; and said at least one charge transport layer is 1, or 2 layers.

28. A photoconductor in accordance with claim 1 wherein said first layer has a thickness of from about 5 to about 70 microns.

29. A photoconductor in accordance with claim 1 wherein said photogenerating layer consists of a photogenerating pigment or photogenerating pigments.

30. A photoconductor in accordance with claim 29 wherein said photogenerating pigment consists of at least one of a metal phthalocyanine, a metal free phthalocyanine, a perylene, and mixtures thereof.

31. A photoconductor in accordance with claim 1 wherein said at least one charge transport layer is from 1 to about 4 layers, and wherein said charge transport component is represented by at least one of

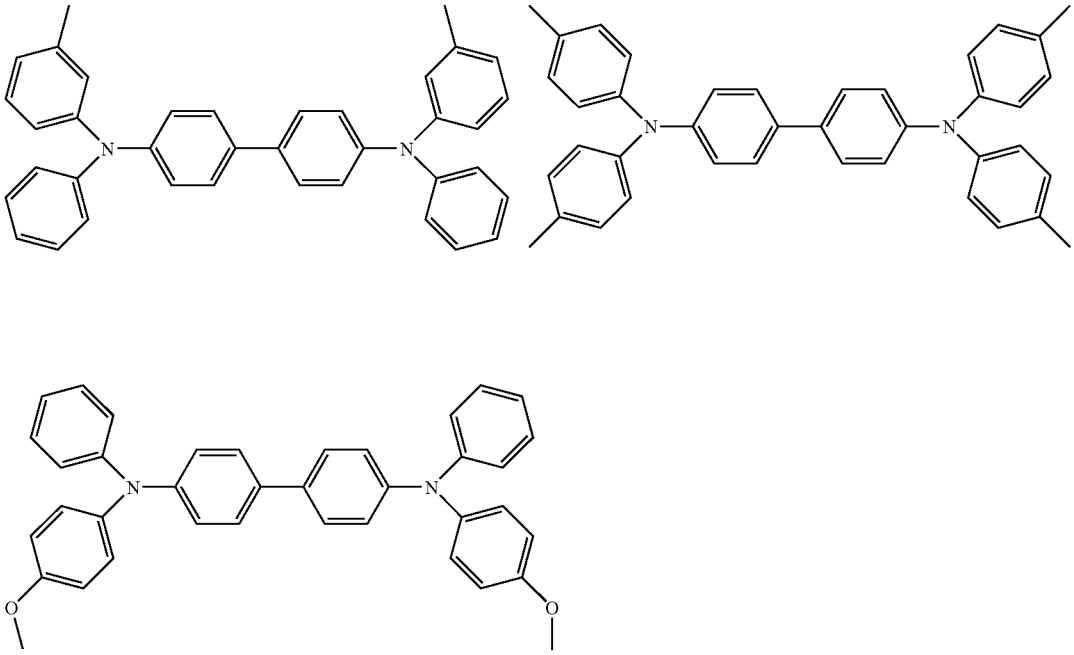

-continued

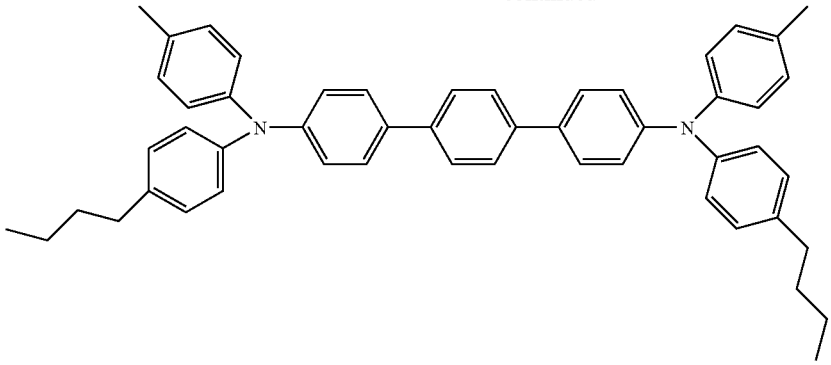

and

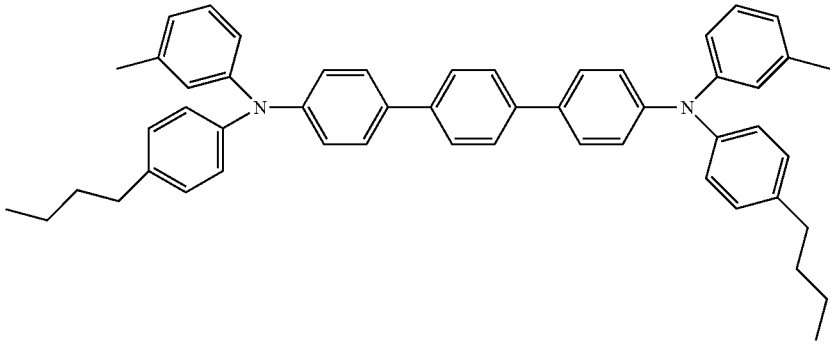

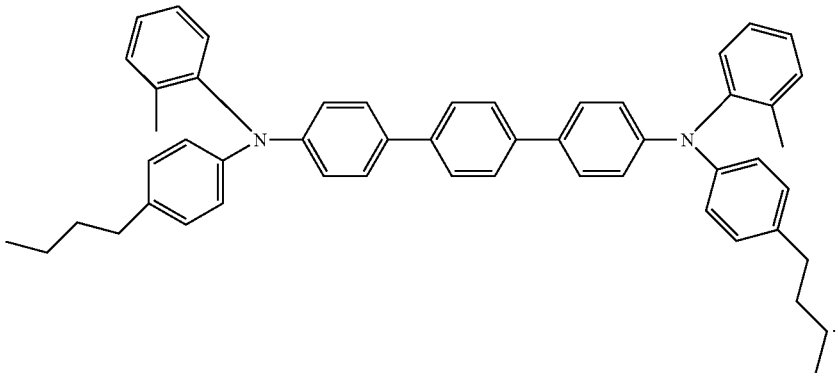

32. A photoconductor in accordance with claim 1 wherein said at least one charge transport layer consists of a top charge transport layer and a bottom charge transport layer, and wherein said top layer is in contact with said bottom layer, and said bottom layer is in contact with said photogenerating layer.

33. A photoconductor consisting of and in sequence of an anticurl backside coating consisting of a crosslinked mixture of a glycoluril resin, and a self crosslinking acrylic resin; a supporting substrate, a hole blocking layer, an adhesive layer, a photogenerating layer thereover, and a charge transport layer, and wherein said mixture of resins has a crosslinking percentage of from about 75 to about 90 percent.

34. A photoconductor in accordance with claim 33 wherein said anticurl backside coating has a thickness of from about 10 to about 50 microns, and wherein said supporting substrate is located between said anticurl charge blocking layer and said photogenerating layer, the top surface of said supporting layer being in contact with said photogenerating layer and the second opposite surface or bottom surface of said supporting substrate being in contact with said blocking layer.

35. A photoconductor consisting of and in sequence of a first layer of an anticurl backside coating layer consisting of an acid catalyst and a crosslinked mixture of a glycoluril resin and a self crosslinking acrylic resin; a second supporting substrate layer; a photogenerating third layer thereover, and a charge transport fourth layer, and wherein said glycoluril resin further comprises a glycoluril represented by

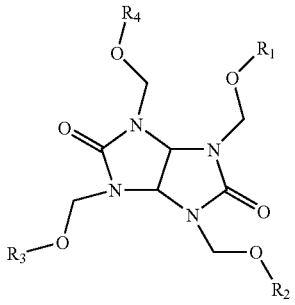

wherein R is alkyl or hydrogen, where alkyl contains from 1 to about 10 carbon atoms, and said mixture of resins have a crosslinking percentage of from 65 to 95.

36. A photoconductor in accordance with claim 35 where R is alkyl.

* * * * *